US006039704A

United States Patent [19]

Domenighini et al.

[11] Patent Number: 6,039,704

[45] Date of Patent: Mar. 21, 2000

[54] HEAD AND FACIAL MASSAGING APPARATUS

[75] Inventors: Pierluigi Domenighini, Lallio; Matteo Clapis, Seriate, both of Italy

[73] Assignee: Italian Beauty Inovations, Inc., New York, N.Y.

[21] Appl. No.: 09/104,380

[22] Filed: Jun. 25, 1998

[51] Int. Cl.[7] ..... A61H 1/00

[52] U.S. Cl. ..... 601/79; 601/79; 601/148; 601/149; 601/151; 601/152

[58] Field of Search ..... 601/46, 48, 70, 601/79, 89, 96, 97, 105, 148, 149, 150, 151, 152; 606/204, 204.15

[56] References Cited

U.S. PATENT DOCUMENTS

| | | | |
|---|---|---|---|
| 2,882,721 | 4/1959 | Corcoran | 601/151 |
| 3,763,853 | 10/1973 | Jochimski | 128/36 |
| 4,052,981 | 10/1977 | Bachmann | 128/36 |
| 5,421,799 | 6/1995 | Rabin et al. | 601/71 |
| 5,569,166 | 10/1996 | Stone | 601/21 |
| 5,881,407 | 3/1999 | Chu Pt | 601/149 |

*Primary Examiner*—Jerome W. Donnelly
*Assistant Examiner*—Tam Nguyen
*Attorney, Agent, or Firm*—Farkas & Manelli Stemberger, E.J.

[57] ABSTRACT

A head and facial massaging apparatus includes a support base constructed and arranged to contact a supporting surface. A headrest structure is operatively associated with the support base. The headrest structure includes a mounting structure and a headrest. The headrest is constructed and arranged to receive and support a rear portion of a user's head. A back shell structure is carried by the mounting structure and has an upper surface and an opposing lower surface. The upper surface includes an expandable bladder structure constructed and arranged to contact a rear portion of a user's head not being supported by the headrest. A source of fluid is provided to control expansion of the bladder structure. A front shell structure is provided having a plurality of resilient fingers extending from a surface thereof. The fingers are constructed and arranged to contact certain facial tissues of the user. Connecting structure secures the front shell structure to the back shell structure to accommodate a user's head therebetween such that the front shell structure is free to move with respect to the user's face. When the front shell structure is secured to the back shell structure with the user's head therebetween, movement of the bladder structure 1) massages the rear portion of the user's head, and 2) causes the user's head to move with respect to the fingers such that the fingers massage the certain facial tissues while the user's head remains in contact with the headrest.

20 Claims, 2 Drawing Sheets

HEAD AND FACIAL MASSAGING APPARATUS

BACKGROUND OF THE INVENTION

This invention relates to head and facial massage and more particularly to a head and facial massaging apparatus which continuously supports the users head while massaging certain facial areas and the occipital area of the user's head.

It is well known in the art that when facial tissue and muscles are massage, the blood circulation in the surrrounding area is increased. This increase minimizes the sagging of facial muscles and prevents dermis and epidermis from being malnourished. In addition, massage of the occipital area may relieve tension and stress.

There are many devices which are used to provide a massaging action on various body parts. Facial masks have also been proposed which are configured to massage certain areas of a user's face. There have been attempts to provide a single massaging device to massage the occipital area and to provide electro-muscle stimulation to facial tissue. Such devices have not been widely accepted since these devices require electric current output on the user's face during operation, which may raise safety concerns.

There is a need to provide a head and facial massaging apparatus which simultaneously massages the occipital area of the user's head via expandable bladders and massages certain facial tissue by resilient fingers without requiring electricity output near the user's face.

SUMMARY OF THE INVENTION

An object of the present invention is to provide an apparatus that simultaneously massages facial tissue and the occipital area of the scalp. In accordance with the principles of the present invention, this objective is obtained by providing a head and facial massaging apparatus having a support base having a generally curved contact surface to contact a supporting surface. A headrest structure is operatively associated with the support base. The headrest structure includes a mounting structure and a headrest. The headrest is constructed and arranged to receive and support a rear portion of a user's head. A back shell structure is carried by the mounting structure and has an upper surface and an opposing lower surface. The upper surface of the back shell structure includes an expandable bladder structure constructed and arranged to contact a rear portion of a user's head which is not being supported by the headrest structure. A source of fluid is provided to control the expansion of the bladder structure. A front shell structure is provided having a plurality of resilient fingers extending from a surface thereof. The fingers are constructed and arranged to contact certain facial tissue of the user. Connecting structure secures the front shell structure to the back shell structure to accommodate a user's head therebetween such that the front shell structure is free to move with respect to the user's face. When the front shell structure is secured to the back shell structure with the user's head therebetween and when the contact surface of the support base is in contact with a supporting surface, movement of the bladder structure 1) massages the rear portion of the user's head not being supported by the headrest, and 2) causes the user's head to move with respect to the fingers such that the fingers massage the certain facial tissue while the user's head remains in contact with the headrest.

Another object of the present invention is the provision of an apparatus of the type described which is simple in construction, effective in operation and economical to manufacture and maintain.

These and other objects of the present invention will become apparent during the course of the following detailed description and appended claims.

DETAILED DESCRIPTION OF THE INVENTION

Figure 1:
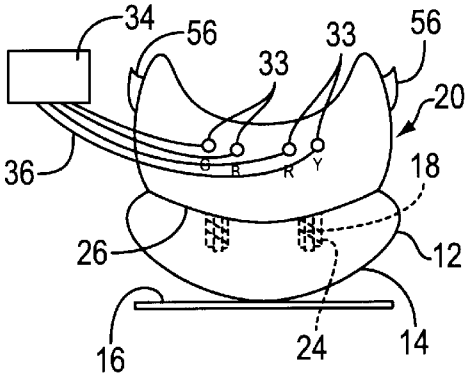
FIG. 1 is a rear view of a support base, back shell structure, and air source of a head and facial massaging apparatus provided in accordance with the principles of the present invention.
Figure 2:
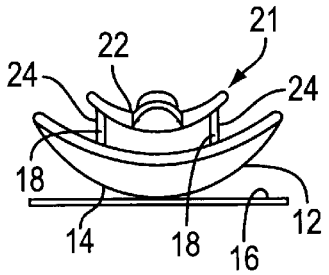
FIG. 2 is a rear view of the support base of the invention, shown without a back shell structure coupled thereto so as to illustrate a headrest structure of the invention.

With reference to FIGS. 1–6, a head and facial massaging apparatus is shown, provided in accordance with the principles of the present invention. The head and facial massaging apparatus includes a support base 12, preferably of hard plastic, having a curved contact surface 14 for contacting a supporting surface 16. As shown in FIG. 2, a headrest structure 21 includes a mounting structure comprising a pair of spacers 18' which support a headrest 22 in spaced relation with respect to the support base 12. One end of each spacer 18 is fixed via a fastener or the like to the support base 12, while the other end of each spacer 18 is fixed to the headrest 22. The headrest 22 defines a cradle which is constructed and arranged to support a rear portion of a user's head thereon. The mounting structure of the headrest structure 21 also includes a pair of coil springs 24 disposed over each spacer 18, the function of which will be explained below.

Figure 3:
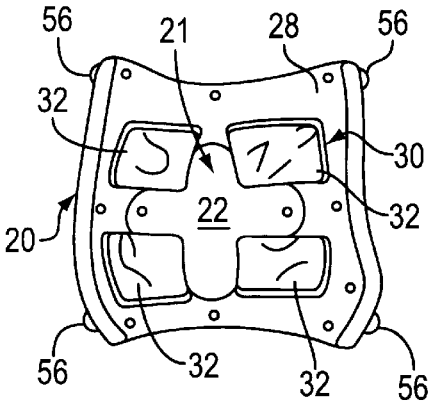
FIG. 3 is a plan view of a back shell structure and the headrest structure of the invention.

With reference to FIGS. 1 and 3, a back shell structure, generally indicated at 20 is carried by the mounting structure of the headrest structure 21. In particular, the back shell structure 20 has a pair of holes (not shown) therethrough, each receiving a second end of an associated spacer 18 so that the second end of each spacer 18 extends through an associated hole. During assembly, the second end of each spacer 18 is passed through an associated hole and is fixed via a fastener or the like to the headrest 22.

As shown in FIGS. 1 and 2, a coil spring 24 is disposed over each spacer 18 and is positioned between an inner surface of the support base 12 and a lower surface 26 of the back shell structure 20. The springs bias the back shell structure 20 towards the headrest structure 21. Thus, the back shell structure 20 is free to move generally vertically with respect to the support base 12 and headrest 22, the function of which will be explained below.

With reference to FIG. 3, the back shell structure 20 has an upper surface 28 (see FIG. 1) which includes bladder structure, generally indicated at 30. The bladder structure 30 is constructed and arranged to contact the occipital area of the user's head or a rear portion of the user's head that is not being supported by the headrest 22. In the illustrated embodiment, the bladder structure 30 comprises four silicon bladders 32, each of generally rectangular configuration having dimensions of approximately 3 inches by 2.3 inches. Each bladder 32 may expand from a generally flat (contracted) condition to approximately one inch in height when supplied with a source of fluid such as air, the function of which will be explained below. In the illustrated embodiment, the bladders 32 are air bladders which receive a source of air.

As shown in FIG. 1, each bladder 32 is associated with an air hose connector 33. Each air hose connector 33 and thus, each air bladder 32 is fluidly coupled to a source of air 34 via a hose 36 so that the bladders 32 may be expanded and contracted via the source of air 34 individually, simultaneously or in combination. Although air is disclosed as the fluid to control movement of the bladders 32, it can be appreciated that any suitable fluid may be used, such as for example, hydraulic fluid.

Figure 4:
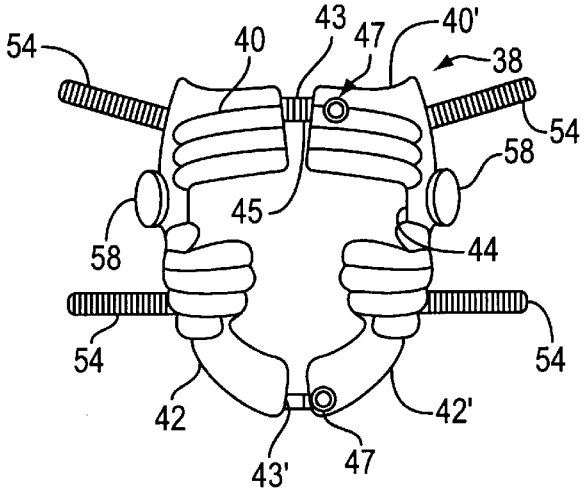
FIG. 4 is a front view of a front shell structure of the head and facial massaging apparatus of the invention.
Figure 5:
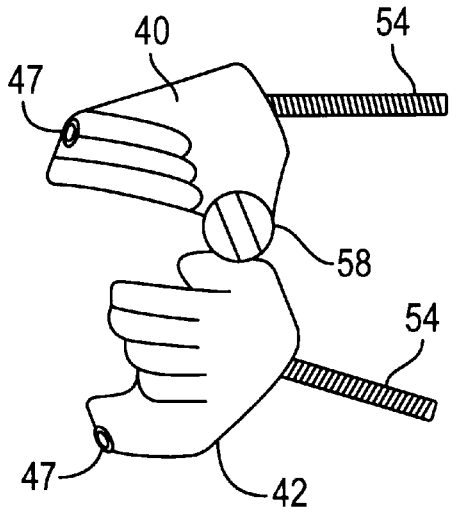
FIG. 5 is a side view of the front shell structure of FIG. 4.
Figure 6:
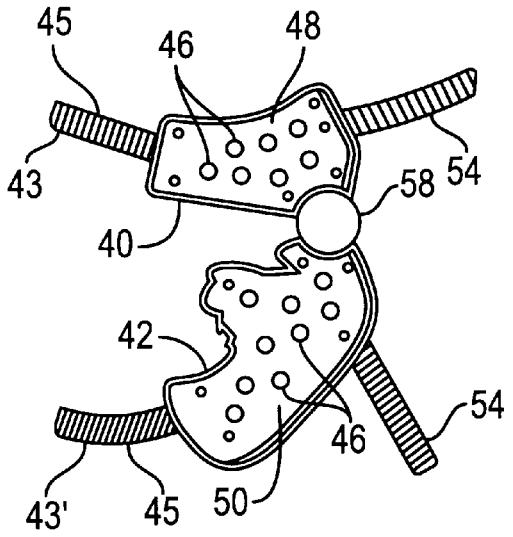
FIG. 6 is a side view of an interior portion of the front shell structure of FIG. 4, showing resilient fingers thereof.

The head and facial massaging apparatus of the invention further includes a front shell structure, generally indicated at 38. With reference to FIGS. 4 and 5, the front shell structure 38 includes a pair of upper members 40 and 40' and a pair of lower members 42 and 42'. The upper members 40 and 40' are coupled together via a first adjustable strap 43, and the lower members 42 and 42' are coupled together by a second adjustable strap 43'. As best shown in FIG. 6, one end of each strap 43 and 43' is fixed to an associated member 40 and 42, while the other end of each strap 43, 43' is a free end. Opposing members 40' and 42' have strap receiving recesses therein to receive the free end of an associated strap.

Each of the straps 43 and 43' are identical and has a plurality of serrations 45 along its length. When the free end of each strap 43 and 43' is received within a receiving recess, a spring-loaded locking structure 47 having a lock member (not shown) engages the serrations 45 of each strap 43 and 43' to lock the straps thereby securing the upper members 40 and 40' together and securing the lower members 42 and 42' together. To adjust the strap 43, 43', a button of the locking structure 47 is pressed to move the lock member against the bias of the spring to release the lock member of the locking structure 47 from the serrations 45.

With reference to FIG. 4, the upper members 40 and 40' are considered to be an upper portion of the front shell structure 38 and are constructed and arranged contact a forehead portion of the user's face. The lower members 42 and 42' are considered to be a lower portion of the front shell structure and are constructed and arranged to contact a maxilla, mandible, and zygomatic portion of the user's face.

Figure 7:
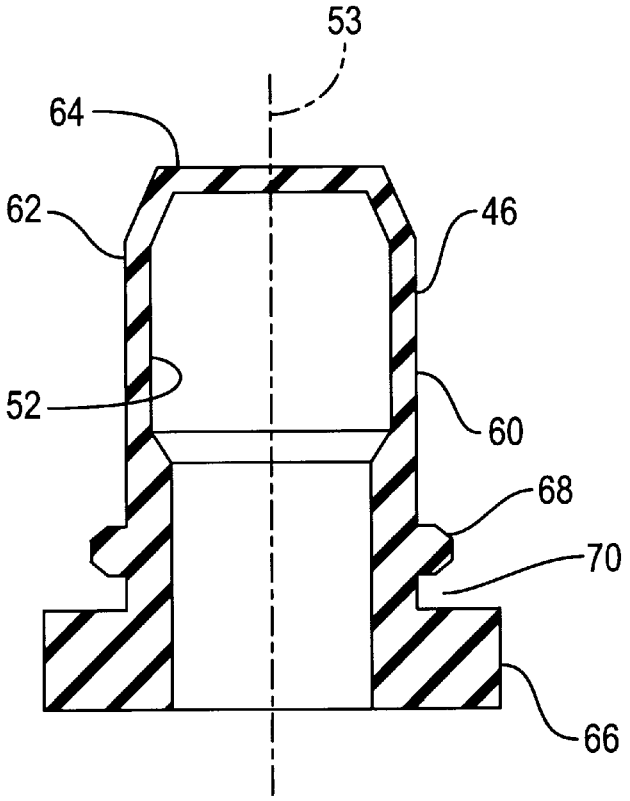
FIG. 7 is an enlarged cross-sectional view of a resilient finger of the front shell structure of the invention.

As shown in FIG. 6, the upper members 40, 40' and the lower members 42, 42' of the front shell structure 38 each includes a plurality of resilient fingers 46 extending from respective inner surfaces 48 and 50 thereof so as to contact with a forehead, maxilla, mandible, and zygomatic portion of the user's face. FIG. 7 is an enlarged cross-sectional view of a resilient finger 46. Each finger 46 is preferably tapered from a large diameter 60 to a smaller diameter 62 and finally to an even smaller end diameter 64. In addition, each finger 46 is made of silicon, and has a hollow portion 52. This construction permits each finger 46 to be compressed and moved side to side (laterally) with respect to an axis 53 thereof when force is exerted thereon, the function of which will become apparent below. In the illustrated embodiment, each resilient finger 46 is identically configured, has a diameter of about 15/32 of an inch and has a operable height of about 0.7 inches. Each finger further 46 includes a base 66, a collar 68 and a recess 70 between the collar 68 and base 66 for use in securing the finger 46 to the front shell structure 38.

Connecting structure is provided to secure the front shell structure 38 with respect to the back shell structure 20 while accommodating the user's head therebetween, such that the front shell structure 38 is free to rotate and to move generally vertically and horizontally with respect to the support base 12 and thus the user's head. In the illustrated embodiment, the connecting structure includes a plurality of straps 54 on the front shell structure 38 which are constructed and arranged to be received by strap receiving members 56 disposed on the back shell structure 20. The straps 54 are identical to straps 43, 43' discussed above, and the strap receiving members 56 are spring-loaded members which have a lock member (not shown) which may engage a serration to lock the strap 54 thereto. The connecting structure is thus adjustable. Other types of straps and fastening means may be employed such as hook and loop type fastening arrangements to secure front shell structure 38, over heads of various sizes, to the back shell structure 20.

In addition, the upper members 40 and 40' of the front shell structure 38 may be adjusted with respect to the associated lower member 42 or 42'. As shown in FIGS. 5 and 6, this adjustment is achieved by providing an adjustment mechanism which includes a connecting portion on each upper member 40 and 40' and on each associated lower member 42 and 42'. The connecting portions are such that when assembled, an upper member and a lower member (for example members 40 and 42) may rotate with respect to each other and thus accommodate user faces of varying sizes. The connecting portion of the upper member 40 includes a hole having female threads, while the connecting portion of the lower member 42 has a hole therethrough. An adjusting knob 58 has a threaded member which is inserted through the hole in the lower member 42 and is received by the female threads in the upper member 40. The knob 58 is then rotated to engage the threaded member with the female threads to lock the upper member 40 and lower member 42 together.

In operation, a user places his or her head on the headrest 22 while the bladders 32 on the back shell structure 24 contact with a rear portion of the user's head which is not being supported by the headrest 22. A portion of the curved contact surface of the support base 12 is in contact with a supporting surface 16. Next, the front shell structure 38 is placed over the user's face and is secured to the back shell structure 20 via the straps 54 and cooperating strap receiving members 56. If adjustment of the front shell structure 38 with respect to the user's face is required, the adjusting knobs may be loosened to rotate the upper and lower member in an adjusting fashion as noted above. This adjustment may be performed prior to connecting the front shell structure 38 to the back shell structure 20.

The spacers 18 support the headrest 22 above the support base 12 The weight of the front shell structure 38 causes the back shell structure 20 to move downwardly against the bias of springs 24. Thus, the springs 24 ensure that the weight of the front shell structure 38 on the user's face is nullified. The bladders 32 are expanded and contracted, via air from the air source 34, individually, simultaneously or combination to create a wide range of different movements of user's head including vertical, horizontal and rotational movement while the rear portion of the user's head contacting the headrest 22 remains in contact with the headrest 22.

In addition, the bladders massage the scalp generally at the occipital area of the user's head. By controlling movement of the bladders 32, the fingers 46 of the front shell structure 38 provide pressure both sideways and generally vertically on facial tissue so as to provide facial massage on the forehead, maxilla, mandible and zygomatic areas of the face.

The air source 34, such as a compressor, is controlled by a microprocessor (not shown) to control expansion and contraction of the bladders 32. Since the contact surface 14 of the support base 12 is curved, a generally rocking or balancing motion of the support base 12 is permitted which aids in the fingers being able to contact and push at various drainage points on the user's face.

It has thus been seen that the objects of this invention have been fully and effectively accomplished. It will be realized, however, that the foregoing preferred embodiment has been shown and described for the purposes of illustrating the structural and functional principles of the present invention, as well as illustrating the methods of employing the preferred embodiments and is subject to change without departing from such principles. Therefore, this invention includes all modifications encompassed within the spirit of the following claims.

What is claimed is:

1. A head and facial massaging apparatus comprising:

a support base having a generally curved contact surface to contact a supporting surface, a headrest structure operatively associated with said support base including a mounting structure and a headrest, said headrest being constructed and arranged to receive and support a rear portion of a user's head, a back shell structure carried by said mounting structure having an upper surface and an opposing lower surface, said upper surface including an expandable bladder structure constructed and arranged to contact a rear portion of a user's head which is not being supported by said headrest, a front shell structure having a plurality of resilient fingers extending from a surface thereof, said fingers being constructed and arranged to contact certain facial tissue of the user, connecting structure to secure said front shell structure to said back shell structure to accommodate a users head therebetween such that said front shell structure may move with respect to the user's face, whereby when said front shell structure is secured to said back shell structure with the user's head therebetween, movement of said bladder structure 1) massages a rear portion of the user's head not being supported by said headrest, and 2) causes the user's head to move with respect to said fingers such that said fingers massage said certain facial tissue while the user's head remains in contact with said headrest, wherein said mounting structure includes at least one spacer to couple said headrest to said support base so that said headrest is in spaced relation with respect to said support base.

2. The apparatus according to claim 1, wherein said mounting structure further comprises a spring associated with said spacer and biasing said back shell structure away from said support base.

3. The apparatus according to claim 2, wherein two spacers and two associated springs are provided and said spring are constructed and arranged such that when said front shell structure is coupled to said back shell structure with a user's head therebetween, weight of said front shell structure causes the back shell structure to move against the bias of said springs.

4. A head and facial massaging apparatus comprising:

a support base having a generally curved contact surface to contact a supporting surface, a headrest structure operatively associated with said support base including a mounting structure and a headrest, said headrest being constructed and arranged to receive and support a rear portion of a user's head, a back shell structure carried by said mounting structure having n upper surface and an opposing lower surface, said upper surface including an expandable bladder structure constructed and arranged to contact a rear portion of a user's head which is not being supported by said headrest, a front shell structure having a plurality of resilient fingers extending from a surface thereof, said fingers being constructed and arranged to contact certain facial tissue of the user, connecting structure to secure said front shell structure to said back shell structure to accommodate a user's head therebetween such that said front shell structure may move with respect to the user's face, and a source of air, whereby when said front shell structure is secured to said back shell structure with the user's head therebetween, movement of said bladder structure 1) massages a rear portion of the user's head not being supported by said headrest, and 2) causes the user's head to move with respect to said fingers such that said fingers massage said certain facial tissue while the user's head remains in contact with said headrest, wherein said bladder structure comprises a plurality of air bladders and said source of air supplies air to said bladders such that said bladders may be expanded and contracted individually, simultaneously or in combination.

5. The apparatus according to claim 1, wherein four air bladders are provided.

6. The apparatus according to claim 1, wherein each of said fingers has a tapered tip, has a hollow portion, and is made of a material capable of being compressed and moved in a lateral direction.

7. The apparatus according to claim 6, wherein said fingers are made from silicon.

8. A head and facial massaging apparatus comprising:

a support base having a generally curved contact surface to contact a support surface, a headrest structure operatively associated with said support base including a mounting structure and a headrest, said headrest being constructed and arranged to receive and support a rear portion of a user's head, a back shell structure carried by said mounting structure having an upper surface and an opposing lower surface, said upper surface including an expandable bladder structure constructed and arranged to contact a rear portion of a user's head which is not being supported by said headrest a front shell structure having a plurality of resilient fingers extending from a surface thereof, said fingers being constructed and arranged to contact certain facial tissue of the user, connecting structure to secure said front shell structure to said back shell structure to accommodate a user's head therebetween such that said front shell structure may move with respect to the user's face, whereby when said front shell structure is secured to said back shell structure with the user's head therebetween, movement of said bladder structure 1) massages a rear portion of the user's head not being supported by said headrest, and 2) causes the user's head to move with respect to said fingers such that said fingers massage said certain facial tissue while the user's head remains in contact with said headrest, wherein said connecting structure includes straps on one of said back shell structure and front shell structure and cooperating strap receiving members on the other of the back shell structure and said front shell structure.

9. A head and facial massaging apparatus comprising:

a support base having a generally curved contact surface to contact a supporting surface, a headrest structure operatively associated with said support base including a mounting structure and a headrest, said headrest being constructed and arranged to receive and support a rear portion of a user's head, a back shell structure carried by said mounting structure having an upper surface and an opposing lower surface, said upper surface including an expandable bladder structure constructed and arranged to contact a rear portion of a user's head which is not being supported by said headrest, a front shell structure having a plurality of resilient fingers extending from a surface thereof, said fingers being constructed and arranged to contact certain facial tissue of the user, connecting structure to secure said front shell structure to said back shell structure to accommodate a user's head therebetween such that said front shell structure may move with respect to the user's face, whereby when said front shell structure is secured to said back shell structure with the user's head therebetween, movement of said bladder structure 1) massages a rear portion of the user's head not being supported by said headrest, and 2) causes the user's head to move with respect to said fingers such that said fingers massage said certain facial tissue while the user's head remains in contact with said headrest, wherein said front shell structure comprises an upper portion and a lower portion, said upper portion being constructed and arranged to contact a forehead portion of the user and said lower portion be constructed and arranged to contact a maxilla, mandible, and zygomatic portion of the user, said upper portion and said lower portion of said front shell structure each including said resilient fingers.

10. The apparatus according to claim 9, wherein said front shell structure includes an adjustment mechanism to adjust a position of the upper portion with respect to the lower portion thereof.

11. The apparatus according to claim 1, further comprising a source of fluid fluidly coupled to said bladder structure to control expansion and contraction of said bladder structure.

12. A head and facial massaging apparatus comprising:

a support base having a generally curved contact surface to contact a supporting surface, a headrest structure coupled to said support base, said headrest structure includes a mounting structure and a headrest, said headrest is constructed and arranged to receive and support a rear portion of a user's head, a back shell structures carried by said mounting structure, has an upper surface and an opposing lower surface, said upper surface includes an expandable bladder structure constructed and arranged to contact a rear portion of a user's head which is not being supported by said headrest, a source of fluid to control expansion of said bladder structure, a front shell structure having an upper portion and a lower portion, said upper portion being constructed and arranged to contact a forehead portion of the user and said lower portion being constructed and arranged to contact a maxilla, mandible, and zygomatic portion of the user, said upper portion and said lower portion of said front shell structure each includes a plurality of resilient fingers extending from a surface thereof so that said fingers may contact the forehead, maxilla, mandible and zygomatic portion of the user, and connecting structure to secure said front shell structure to said back shell structure to accommodate a user's head therebetween such that said front shell structure may rotate and move vertically and horizontally with respect to said support base and the user's face, whereby when said front shell structure is secured to said back shell structure with the user's head therebetween, movement of said bladder structure 1) massages said rear portion of the user's head not in contact with said headrest and 2) causes the user's head to move with respect to said fingers such that said fingers massage facial tissue at the forehead, the zygomatic portion, maxilla, and mandible areas of the user's face while the user's head remains in contact with said headrest.

13. The apparatus according to claim 12, wherein said mounting structure includes at least one spacer to couple said headrest to said support base so that said headrest is in spaced relation with respect to said support base.

14. The apparatus according to claim 13, wherein said mounting structure further comprises a spring associated with said spacer and that biases said back shell structure away from said support base.

15. The apparatus according to claim 12, wherein said bladder structure comprises a plurality of air bladders and said source of fluid supplies a source of air to said bladders such that said bladders may be expanded and contracted individually, simultaneously or in combination.

16. The apparatus according to claim 12, wherein each of said fingers has a tapered tip, has a hollow portion, and is made of a material capable of being compressed and moved laterally.

17. The apparatus according to claim 16, wherein said fingers are made from silicon.

18. The apparatus according to claim 12, wherein said connecting structure includes straps on one of said back shell structure and front shell structure and cooperating strap receiving members on the other of the back shell structure and said front shell structure.

19. The apparatus according to claim 12, wherein said front shell structure includes an adjustment mechanism to adjust a position of the upper portion with respect to the lower portion thereof.

20. A method of facial and head massage includes:

providing an apparatus comprising:

a support base having a generally curved contact surface to contact a supporting surface, a headrest structure operatively associated with said support base, said headrest structure including a mounting structure and a headrest, said headrest is constructed and arranged to receive and support a rear portion of a user's head, a back shell structure carried by said mounting structure and having an upper surface and an opposing lower surface, said upper surface including expandable bladder structure constructed and arranged to contact a rear portion of a user's head which is not being supported by said headrest, a front shell structure having a plurality of resilient fingers extending from a surface thereof, connecting structure to secure said front shell structure to said back shell structure, and a source of fluid fluidly coupled to said bladder structure, placing a rear portion of a user's head in contact with said headrest, with said contact surface of said support base contacting said supporting surface, placing said front shell structure over a portion of the user's face such that said fingers contact facial tissue, connecting said front shell structure to said back shell structure via said connecting structure, operating said source of fluid to selectively expand and contract said bladder structure to 1) massage a rear portion of the user's head not in contact with said headrest, and 2) cause the user's head to move with respect to said fingers such that said fingers massage said facial tissue while the user's head remains in contact with said headrest.

* * * * *